United States Patent [19]

Petitjean

[11] Patent Number: 4,830,429

[45] Date of Patent: May 16, 1989

[54] DEVICE FOR OPERATING A MULTIPLE POSITION ARMCHAIR, SEAT OR COUCH, INCLUDING A MEANS FOR SUPPORTING THE SMALL OF THE BACK

[76] Inventor: Michel Petitjean, 42120 Le Coteau, 29, rue Varenne, France

[21] Appl. No.: 146,840

[22] Filed: Jan. 22, 1988

[30] Foreign Application Priority Data

Jan. 23, 1987 [FR] France ..... 87 00802

[51] Int. Cl.[4] ..... A47C 3/00

[52] U.S. Cl. ..... 297/284; 297/61

[58] Field of Search ..... 297/61, 284

[56] References Cited

U.S. PATENT DOCUMENTS

| | | | |
|---|---|---|---|
| 3,880,462 | 4/1975 | Mednick | 297/84 |
| 4,040,661 | 8/1977 | Hogan et al. | 297/61 |
| 4,313,637 | 2/1982 | Barley | 297/284 |
| 4,691,961 | 9/1987 | Rogers et al. | 297/61 |

FOREIGN PATENT DOCUMENTS

| | | |
|---|---|---|
| 1527147 | 4/1968 | France . |
| 1256526 | 2/1981 | France . |

*Primary Examiner*—James T. McCall

*Attorney, Agent, or Firm*—Michael N. Meller

[57] ABSTRACT

The present invention relates to an operating device for a seat, an armchair or a couch, where the angle between the base (3) and the back(4) can be modified, so that the user can move from a sitting position to a position of relaxation, merely through the action of his body. The invention provides a retractable supporting means for the small of the back comprised of a flap (10) pivoting around an axis (11) and of a support (32) with a roller (33), integral with the base, and capable of positioning the retractable supporting means for the small of the back by pivoting the flap as the displacement of the user's body proceeds.

6 Claims, 2 Drawing Sheets

DEVICE FOR OPERATING A MULTIPLE POSITION ARMCHAIR, SEAT OR COUCH, INCLUDING A MEANS FOR SUPPORTING THE SMALL OF THE BACK

The object of the present invention is a mechanism for a furniture item, such as a variable position seat or armchair.

More particularly, the invention is directed to seats, where the relative inclination between the base, the back and the various associated elements can be modified. These modifications enable the user to achieve a multiplicity of positions, intermediate between two extreme positions, in order to improve his comfort. These different positions are achieved by the user merely moving his body, without any need to actuate a lever, or some other operating handle.

BACKGROUND ART

Such devices are available as a fixed frame with a movable base connected to a back, also movable, provided with an attachment in the form of a head-rest. It so happens that in the first position, where the base is moved completely back, the user finds himself in the normal sitting position, and the angle between the back and the base is close to 90°. The head-rest is then generally retracted, since the user is in the active position. Should the user wish to assume a more relaxing position, he moves the base forward through a movement of his body, whereby the angle between the back and the base is increased above 90°, while at the same time, the head-rest moves to become an extention of the back. An ergonometric problem remains however, since the user is in a semi-inclined position and is supported only at the upper part of his back and, further down, by the base, while no support is provided at the small of the back.

OBJECT OF INVENTION

Accordingly, the object of the present invention is to obviate this disadvantage, and to provide a device for operating a seat, an armchair or a couch including a movable base, as well as a inclinable back connected to this movable base, completed by a retractable head-rest, characterized in that a retractable means for supporting the small of the back is included. The invention is more particularly characterized in that this means for supporting the small of the back is in a retracted position when the device is used for sitting and the angle between the back and the base is in the vicinity of 90°, and in that it positions itself gradually as the user adopts a position closer to the extreme advanced position, i.e. that of relaxation. The back is inclined and the head-rest is raised. This device is further characterized in that the retractable means for supporting the small of the back is a flap capable of pivoting around a horizontal axis situated in the plane of the back, and in that the positioning means is comprised of a fixed support connected to the movable base and provided at its end with a rotatable supporting means of the roller type.

BRIEF DESCRIPTION OF THE DRAWINGS

Other advantages and details will become apparent from the description of a preferred non-limiting particular embodiment, given with reference to the appended figures, wherein.

DETAILED DESCRIPTION OF THE DRAWINGS

Figure 1:
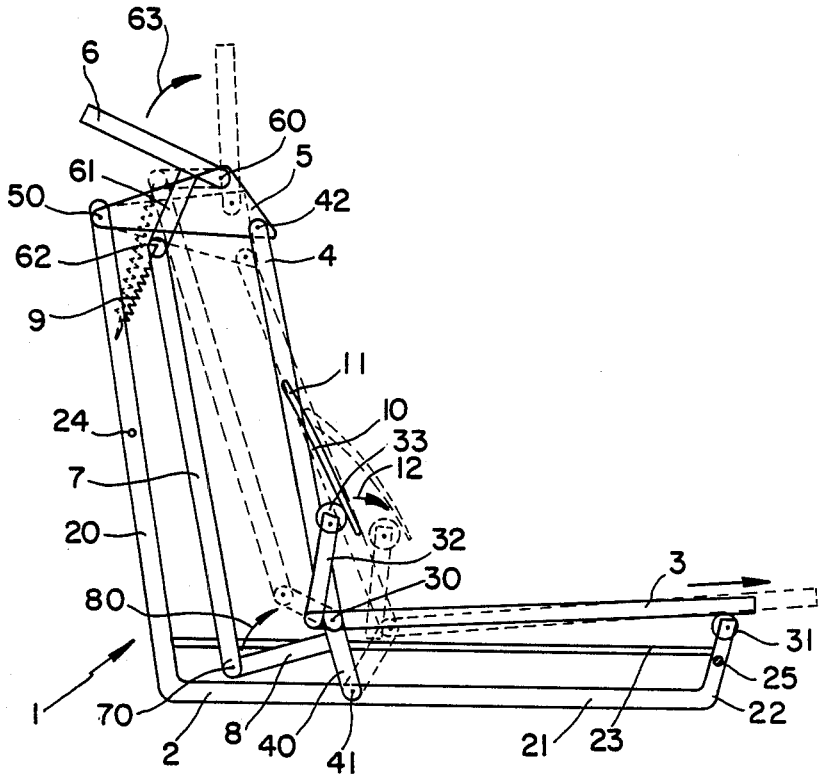
FIG. 1 is a side view of the device according to the preferred embodiment of the invention in its two extreme positions.

The seat 1 according to the preferred embodiment of the invention comprises a fixed rigid structure 2 constructed from tubes, generally made of metal with an appropriate circular or square cross section. This structure includes on each side thereof a substantially vertical rod 20, a horizontal rod 21 acting to support the whole structure on the ground and another substantially vertical rod 22 located at the opposite end of the rod 21. The horizontal cross-piece 23 is parallel with the horizontal rod 21 and serves to render the structure partly rigid by linking the vertical rods 20 and 22. Also, the cross-pieces 24 and 25 serve to render the structure rigid by linking, respectively, the back and the front vertical rods so as to provide a rigid frame onto which the whole movable articulation will be adapted.

The movable articulation comprises essentially to a movable base 3 as well as a movable back 4 pivotally coupled on each side thereof to this base by a pivot 30 enabling the angle between the base and the back to be varied. This assembly of the base and back is mounted to be pivotally supported on the structure 2 through an extension 40 which is pivotally coupled to the horizontal rod 21 at pivot 41. The front part of the base 3 remote from the pivot 30, is capable of movement while being supported by at least one roller 31 mounted on the vertical front rod 22.

The upper end of the back 4, remote from pivot 30, is pivotally coupled on each side thereof to a linking plate 5 the axis 42. This linking plate 5 is also pivotally coupled by pivot 50 to the vertical rod 20, this plate being mounted in parallel relation to the plane defined by the three rods 20, 21, and 22. The head-rest 6 is pivotally coupled on each side by pivot 60 to plate 5. This head-rest 6 includes in its back part a fixed lever 61 arranged substatially perpendicular to the plane of the head-rest and at a location offset with respect to the pivot 60. One end of this lever 61 is also provided with a pivot 62 onto which one end of a connecting rod is rotatably coupled to lever 61, whereas the other end of connecting rod 7 is not coupled by the pivot 70 to a second lever 8 mounted fixedly to be perpendicular to the extension 40. The extension 40, lever 8, connecting rod 7, lever 61, head-rest 6, linking plate 5 and back 4 thus constitute an articulated polygon. A pull-back spring 9 is attached at end to the vertical rod 20 of the fixed structure 2 and at its other end to the pivot 62.

The means for supporting the small of the back per se is comprised of a flap 10 of curved shape designed fit to the morphology of individuals and to provide a satisfactory ergonomy, which flap is pivotally mounted on a horizontal rod 11 arranged in the plane of the back 4. On the other hand, the base 3 includes at its back end at least one fixed support 32 at the end of which is positioned at least one roller 33, in such a manner that the flap 10 of the means for supporting the small of the back is supported by this roller and the roller is capable of rolling against the lower surface of the flap.

The position adopted by the device during the forward movement of the base 3, effected by the user varying the position of this body, is illustrated by dotted lines. Simultaneously, the pivot 30 pulls forward the lower end of the back 4, as well as the upper end of the extension 40. This same back 4, being pivotally coupled by the pivot 42 to the plate 5, is inclined backwards, and the angle between the back and the base increases to greater than 90°. The forwardly drawn extension 40 therefore changes totally the orientation of the lever 8, which moves along an ellipsoid curve indicated by the arrow 80 and, simultaneously, moves the connecting rod 7 upwards, which in turn changes the orientation of the lever 61, as indicated by the arrow 63, to bring it into an almost horizontal position, thereby placing the head-rest 6 in a position where it is slightly inclined backwards, since the lever 61 and the head-rest 6 are perpendicular to one another. The spring 9 is then tensioned in a pull-back position.

Simultaneously, the roller 33 has therefore undergone a displacement identical to that of the base 3, while the rod 11 has moved slightly downwards, without undergoing a displacement as important as that of the base, because rod 11 is located close to the pivot axis of the back 4. One understands that the flap 10, having moved as indicated by the arrow 12, is then located at a greater distance from the back 4 and is therefore capable of filling up the space left vacant by the user in a position of relaxation, thus functioning as a support, a function necessary to the user's comfort in this position.

Figure 2:
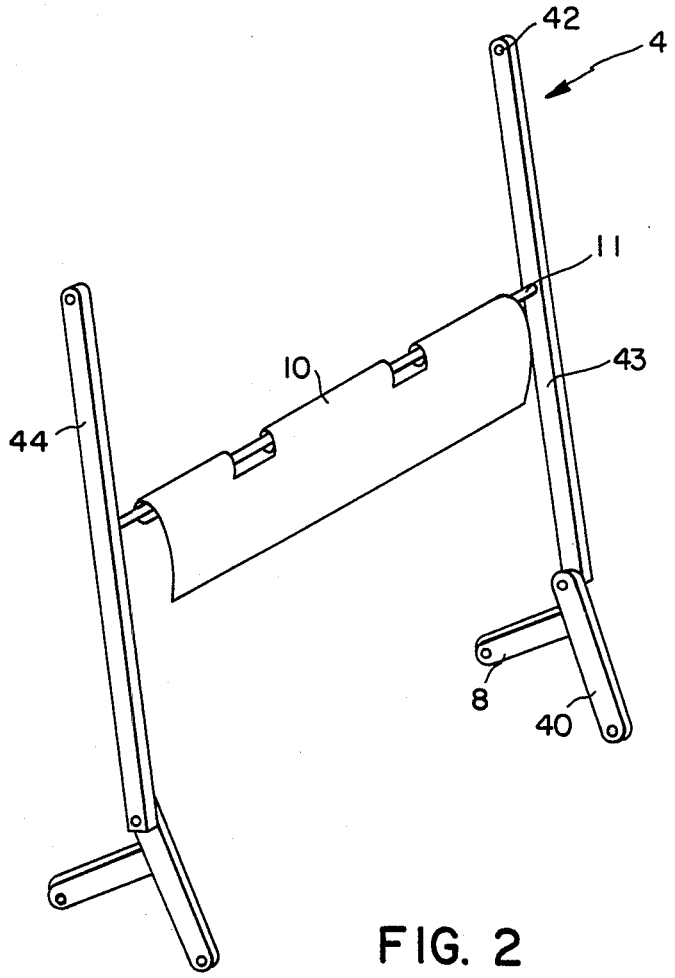
FIG. 2 is a perspective view of the means for supporting the small of the back according to the invention.

In FIG. 2, there are shown even more clearly the lateral rods 43 and 44 of the back 4, as well as the bore for the passage of the pivot 42 coupling these rods to the plate 5. Also, this figure shows the extension 40 and the lever 8 perpendicular thereto and through which the head-rest can be raised by means of the connecting rod 7 and the additional lever 61. The flap 10 situated in the plane of the back 4 and perpendicular to the rods 43 and 44. The shape of this flap is obviously given only for illustrative purposes, and can assume any appropriate shape, which those skilled in the art wish to confer to it, in order to conform as well as possible to the contour of the small of the back of the user.

One also understands that the base can be provided with elbow-rests integral therewith and that the head-rest can be operated by other means without departing from the scope of the invention.

Also, it is possible to provide controls on the different rods, thus enabling the displacement of the articulated polygon to be modified and the range of the movements to be adjusted.

When the armchair is not in use, the pull-back spring pulls it into the sitting position, but it is understood that the same effect could be achieved by connecting the back end of the base 3 directly to the vertical rod 20 by means of a spring.

The present invention is not limited to the exemplary embodiment which has been described, but is, on the contrary, capable of modifications and variations which will be apparent to those skilled in the art.

I claim:

1. An actuation device for a multi-position seat such as an armchair or a couch comprising:

a fixed frame structure having a substantially horizontal seat portion and a substantially vertical back portion;

a movable frame structure having a seat portion and a back portion which are respectively substantially horizontal and substantially vertical when said seat portion of said movable frame structure is in a first position, said seat portion of said movable frame structure being movable relative to said seat portion of said fixed frame structure and said back portion of said movable frame structure being movable relative to said back portion of said fixed frame structure, and said seat portion of said movable frame structure being pivotable relative to said back portion of sad movable frame structure;

first and second linking members each pivotally coupled to both said fixed and movable frame structures;

a flap member pivotally coupled to said back portion of said movable frame structure; and a support member fixedly mounted on said seat portion of said movable frame structure, said support member being arranged to contact said flap member at a point on said flap member away from a point at which said flap member is pivotally coupled to said back portion of said movable frame structure, whereby said back portion of said movable frame structure pivots away from its substantially vertical position and said flap member is caused to pivot in a forward direction relative to said back portion of said movable frame structure by said support member in response to said seat portion of said movable frame structure being translated in said forward direction from said first position to a second position.

2. The actuation device as defined in claim 1, wherein a head support is pivotally coupled to said first linking member and is coupled to said back portion of said movable frame structure by way of third, fourth and fifth linking members pivotally coupled in series therebetween, whereby said head support is moved from a position of rearward inclination relative to said back portion of said movable frame structure to a position of substantial alignment with said back portion of said movable frame structure in response to said seat portion of said movable frame structure being translated from said first position to said second position.

3. The actuation device as defined in claim 1, wherein said back portion of said movable frame structure comprises first and second frame members arranged in parallel and connected by a substantially horizontal connecting member, said flap member being pivotally coupled to said connecting member and said first frame member being pivotally coupled to said first linking member.

4. The actuation device as defined in claim 2, wherein said third linking member is fixedly connected to said head support, said fifth linking member is fixedly connected to said back portion of said movable frame structure, and said fourth linking member is pivotally coupled to said third and fifth linking members.

5. The actuation device as defined in claim 1, wherein said seat portion of movable frame structure is urged toward said first position by a spring means.

6. The actuation device as defined in claim 5, wherein said spring means is coupled to said back portion of said fixed frame structure and to one of said linking members.

* * * * *